United States Patent [19]

Baboian et al.

[11] 4,226,694

[45] Oct. 7, 1980

[54] CATHODIC PROTECTION SYSTEM FOR A MOTOR VEHICLE

[75] Inventors: Robert Baboian, Johnston, R.I.; Gardner S. Haynes, Attleboro; Richard G. Delagi, Sharon, both of Mass.

[73] Assignee: Texas Instruments Incorporated, Dallas, Tex.

[21] Appl. No.: 714,444

[22] Filed: Aug. 16, 1976

[51] Int. Cl.[3] ..... C23F 13/00

[52] U.S. Cl. ..... 204/196

[58] Field of Search ..... 204/147, 148, 196, 197, 204/290 F

[56] References Cited

U.S. PATENT DOCUMENTS

| | | | |
|---|---|---|---|
| 3,133,872 | 5/1964 | Miller et al. | 204/290 F |
| 3,151,050 | 9/1964 | Wilburn | 204/147 |
| 3,216,916 | 11/1965 | Locke | 204/196 |
| 3,330,751 | 7/1967 | Warner | 204/196 |
| 3,360,452 | 12/1967 | McNulty | 204/197 |
| 3,498,898 | 3/1970 | Bogart et al. | 204/196 |
| 3,684,680 | 8/1972 | Heuze | 204/290 F |
| 3,736,243 | 5/1973 | Duggan | 204/196 |
| 3,838,035 | 9/1974 | Pumphrey | 204/290 F |
| 3,868,313 | 2/1975 | Gay | 204/147 |
| 3,893,903 | 7/1975 | Lindholm | 204/197 |

*Primary Examiner*—G. L. Kaplan

*Attorney, Agent, or Firm*—John A. Haug; James P. McAndrews

[57] ABSTRACT

An improved impressed current cathodic corrosion protection system for a motor vehicle having metallic parts to be protected against corrosion in the presence of condensation, road splash and high humidity conditions includes a direct current power source and means electrically connecting the negative pole of the power source to the metallic parts of the vehicle. An electrically insulating, hydrophilic, corrosion barrier coating is formed on the metallic parts of the vehicle to be protected and an electrode of electrochemically inert material is mounted in closely spaced electrically insulated relation to the metallic parts of the vehicle in a location to be electrolytically coupled to any metallic parts of the vehicle exposed through the coating by an electrolyte which forms on the hydrophilic coating as a result of wetting of the coating by any condensation, road splash or high humidity conditions, the electrode being electrically connected to the positive pole of the power source. The electrically insulating, hydrophilic nature of the corrosion barrier coating and the location of the electrode relative to the coating cooperate to permit large metallic areas of the vehicle to be cathodically protected with a single anode even when only limited condensation or road splash or the like occurs and cooperate to reduce power consumption of the system to the level necessary to protect only those metallic parts of the vehicle exposed through the coating, thereby to adapt the system to the power supply capabilities of motor vehicles.

8 Claims, 3 Drawing Figures

CATHODIC PROTECTION SYSTEM FOR A MOTOR VEHICLE

BACKGROUND OF THE INVENTION

This invention relates to an impressed current cathodic protection system and more particularly to an impressed current cathodic protection system for a vehicle.

In the prior art impressed current cathodic protection has been used for corrosion protection of metallic members such as vessels, oil rigs, and pipelines. In these applications the cathodic protection consists of bringing the electrolyte potential of the metallic member to an appropriate potential relative to a reference electrode by means of a direct voltage source. For example, for steel, cathodic protection is maintained below −0.80 volt vs. the saturated calomel electrode. The anode, typically of a chemically inert material, is mounted near the metallic member which serves as the cathode.

It has also been suggested that impressed current cathodic protection can be used for the protection of the metallic parts of vehicles such as automobiles, trucks, etc. However, there are some problems in using cathodic protection for a vehicle. First, the electrolyte (typically water due to condensation or road splash) for the cathodic protection is not always present or is not present uniformly in all metallic parts. Second, the power requirements for protecting the metallic parts can be large which would require a large power supply which is undesirable for use in a vehicle. Finally, a large surface area need be protected by the anode.

Accordingly, it is an object of the present invention to provide for an improved cathodic protection system.

It is another object of the present invention to provide a cathodic protection system with a reduced power requirement while still providing cathodic protection to a large surface area.

It is still another object of the present invention to provide a cathodic protection system which is easy and inexpensive in construction and reliable in operation. Other objects and features of this invention will be in part apparent and in part pointed out hereinafter.

Briefly the impressed current cathodic protection system of this invention comprises metallic parts of a vehicle to be protected, a suitable coating, a power source and at least one anode. The coating such as paint, rubber linings, films of synthetic material or the like is applied to the metallic parts to form a protective, electrically insulative coating against corrosion. The coating is also preferably hydrophilic with a high-spreading tendency. An electrochemically active, inert anode preferably with a platinum surface is positioned adjacent to the metallic part while still being electrically separated so shorting does not occur between them when connected to an electrical source of power. The positioning also is preferably at an area of the metallic part where moisture that comes in contact with the part such as condensation, road splash, etc. will be present the longest time thereby maintaining electrolyte continuity between anode and cathode. The negative pole of the power source is connected to the metallic part and the positive pole to the anode so that the electrochemical potential of the metallic part can be kept below a suitable value. Additionally, an electrical current limiting or electrical potential limiting device may be used between the power source and the anode.

In operation moisture acts as the electrolyte in the system between the metallic part cathode and the anode. The anode is mounted in closely spaced, electrically insulated relation to the metallic parts of the vehicle in a location to be electrolytically coupled to any metallic parts of the vehicle exposed through the coating by the electrolyte resulting from wetting of the coating. The use of the corrosion protection coating provides advantages over a bare metal cathodic protection system. The system with the coating has a minimal power requirement and can provide protection for areas far removed from the anode. That is, only the areas of the metallic part that develops defects (scratches and other imperfections in the coating) need current for protection. That means a power supply such as a standard 12 volt battery can be used for supplying the power to the metallic part for extended periods of time. Also as the coating develops more defects with time the cathodic protection system protects corrosion in these areas from taking place.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
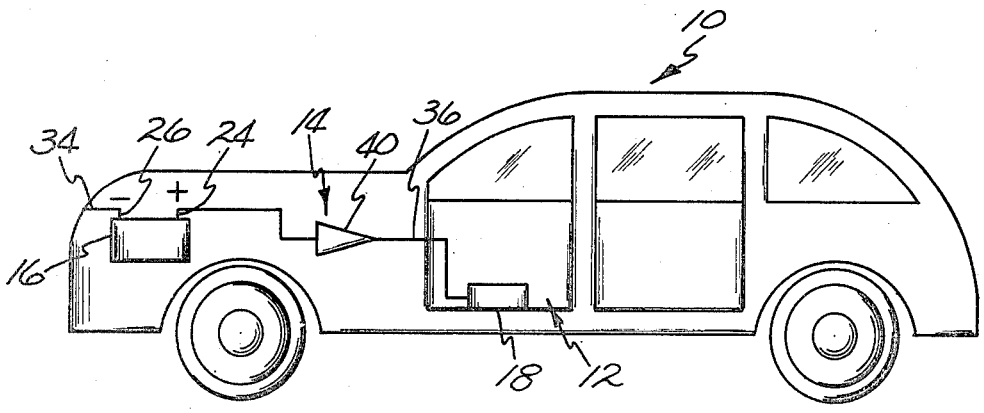
FIG. 1 is a diagrammatical view of a vehicle with the cathodic protection system of this invention.

Referring now to FIG. 1, numerical 10 denotes a vehicle such as an automobile having a metal part or body 12. Automobile 10 contains an anti-corrosion impressed current cathodic protection system 14 of this invention.

Cathodic protection system 14 basically comprises a power supply 16, an inert anode 18, and metallic part 12 with an anti-corrosive coating 22 thereon.

The power supply 16 preferably is a D.C. voltage source such as a standard storage battery. Battery 16 has a positive pole 24 and a negative pole 26.

Figure 2:
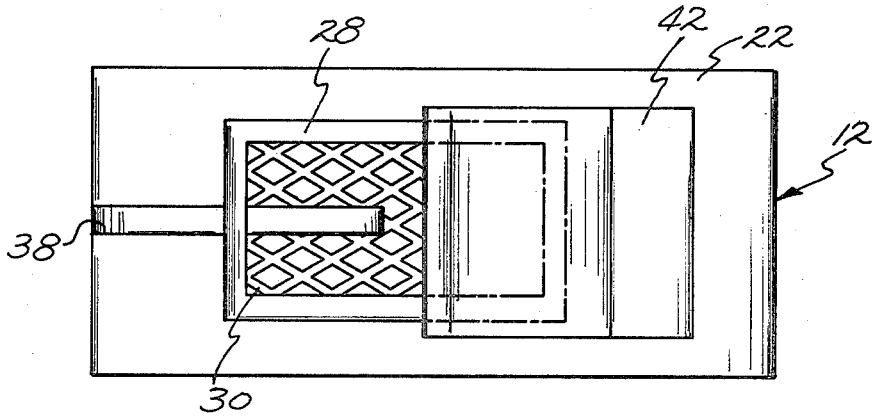
FIG. 2 is a top plan view of the anode and the metallic vehicle cathode part of FIG. 1.

As best shown by FIGS. 2 nd 3 anode 18 has a support structure or frame 28 made from an electrically insulating material such as an organic polymer with an anode portion 30 contained therein. The structure preferably has leg members 29 or other spacing means to space anode portion 30 from the body part as will be more completely explained below. Anode portion 30 is preferably of an electrochemically inert material having an electroactive surface and a low consumption rate under anodic conditions. Platinum and platinum group metals provide such an anode member and when cladded, electroplated or the like on a corrosion resistant substrate such as titanium, columbium or tantalum provide a cost effective product. Since the anodic reaction involves the evolution of gas, preferably venting is provided in the anode by using an open cavity frame with an expanded mesh anode.

In accordance with this invention, metallic part 12 is covered with the suitable corrosion resistant, electrically, insulating coating 22 such as paint, varnish, rubber lining, synthetic coating or the like. The coating also is preferably a wettable hydrophilic coating in which beading of electrolyte is minimized. That is, a coating that promotes surface activity or has a positive spreading coefficient so that the electrolyte will spread over the coating. Typically this is a coating which provides for the liquid vapor interface energy to be less than the solid vapor interface energy. This coating covers the entire surface of the bare metal and seals and protects it from corrosion but it is to be understood that the coating can have and/or will develop defects. That is, the coating is only part of the corrosion protection system of this invention with a primary purpose to keep the power requirement of the system low. Additionally the coating should be able to withstand the acidic condition around the anode without degradation. If the coating is subject to degradation under the acidic conditions, a secondary coating 32 in the immediate vicinity of the anode may be used. An example of a suitable secondary coating is an epoxy coal tar.

A first conducting wire 34 of conventional insulated electrical wire connects negative pole 26 of storage battery 16 to the body. A second conducting wire similar to wire 34 connects the positive pole to an anode connector wire 38 made from a corrosion resistant material such as titanium, columbium, or tantalum. The anode connector is needed because of the corrosive conditions around the anode. However, if the insulated anode wire 36 connected to the active anode material is embedded in the support structure 28, the anode connector wire is not needed.

A current limiting or a potential limiting device 40 may be used connected in series between the storage battery and the anode. These devices respectively control current, typically by means of a resistor, or regulate the electrical potential between the anode and the metallic body such that the electrochemical potential of the metallic body is kept below a suitable value.

Electrolyte for the system is supplied by moisture due to rain, road splash, condensation or the like. Typically the moisture stays in certain parts of the car longer than in others such as in the bottom of a door.

Figure 3:
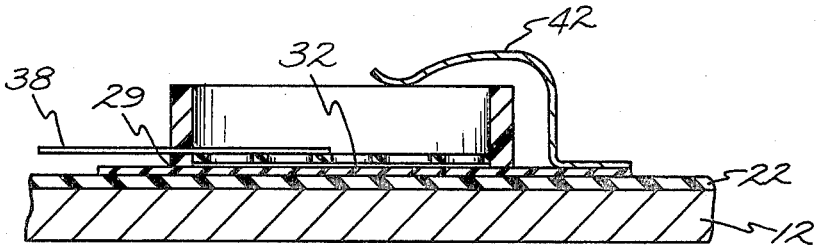
FIG. 3 is a cross sectional view of the anode and metallic vehicle cathode part of FIG. 2.

Accordingly anode 18 is mounted in closely spaced electrically insulated relation to the body part 12 with an attachment means such as a metal clip 42 as shown in FIGS. 2 and 3. The metal clip makes contact with the insulative anode support structure or frame to electrically isolate the clip from the anode portion. The frame also electrically isolates the anode portion 30 from the body while still keeping the two as close as possible to each other. A typical separation distance is in the order of 0.020 of an inch which allows for electrolyte film flow. The positioning of the anode is done on the coated body in an area which is first to wet and last to dry. This provides maximum continuity and protection in the wet and dry cycle an automobile experiences.

In operation, impressed current is applied between the anode and the metallic body part. The electrochemically inert anode is positioned in a location to be electrolytically coupled to the metallic parts of the vehicle exposed through the coating by the electrolyte resulting from wetting of the hydrophilic coating. Only the parts of the body in which a coating defect exists need protection so the power requirement is low thereby allowing use of conventional storage battery. Additionally the use of the coating allows the anode to provide protection far removed from the placement of the anode. The protection of the body remains as long as electrolyte is present in the system and starts up again upon its renewed presence. When the electrolyte is not present, protection is not needed because the corrosion producing moisture is gone.

In view of the above, it will be seen that the several objectives of the invention are achieved and the other advantageous objects attained.

As various changes could be made in the above construction without departing from the scope of the invention, it is intended that all matter contained in the above description or shown in the accompanying drawings shall be interpreted as illustrative and not in a limiting sense.

We claim:

1. An improved impressed current cathodic protection system for a wheel mounted vehicle comprising a metallic body part of said vehicle, a corrosion resistant, electrically insulative coating covering said metallic body part, at least one anode member mounted in closely spaced, electrically insulated relation to said metallic body part extending over only a relatively small portion of said metallic body part and in a position to be electrolytically coupled to any portions of said metallic body part exposed through the coating by an electrolyte wetting said coating, and a D.C. voltage source having a positive pole electrically connected to said anode and a negative pole electrically connected to said metallic body part.

2. An improved impressed current cathodic protection system as set forth in claim 1 further providing that said coating is hydrophilic so that said electrolyte for said system will spread over the coating.

3. An improved impressed current cathodic protection system as set forth in claim 2 wherein said anode is composed of inert material and is positioned on said metallic body part in an area which is first to wet and last to dry.

4. An improved impressed current cathodic protection system as set forth in claim 3 further including a current limiting device connected in series between said D.C. voltage source and said anode.

5. An improved impressed current cathodic protection system as set forth in claim 3 further including a potential limiting device coupled between said D.C. voltage and said anode.

6. An improved impressed current cathodic protection system as set forth in claim 3 wherein said anode has an open cavity frame with an electrochemically inert anode portion having an electroactive surface and a low consumption rate under anodic conditions.

7. An improved impressed current cathodic protection system as set forth in claim 6 wherein said anode portion is expanded mesh having its outer surface made from platinum.

8. An improved impressed current cathodic protection system as set forth in claim 7 further providing for a secondary coating in the immediate vicinity of the anode directly adjacent said corrosion resistant coating which is able to withstand the acidic conditions around the anode without degradation.

* * * * *